US006253379B1

(12) United States Patent
Collier

(10) Patent No.: US 6,253,379 B1
(45) Date of Patent: Jul. 3, 2001

(54) JACKET WITH AN IN-SLEEVE POCKET

(75) Inventor: John Joseph Collier, Boulder, CO (US)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/510,369

(22) Filed: Feb. 22, 2000

(51) Int. Cl.[7] ..... A41B 1/00
(52) U.S. Cl. ..... 2/108; 2/69; 2/247; 2/125
(58) Field of Search ..... 2/108, 69, 83, 2/85, 93, 94, 247–251, 125, 126

(56) References Cited

U.S. PATENT DOCUMENTS 2,073,711 * 3/1937 Robinsohn ..... 2/126
2,700,769 * 2/1955 Polchinski ..... 2/85
3,193,842 * 7/1965 Bell ..... 2/108
4,006,495 2/1977 Jones .
4,302,850 * 12/1981 Maeshima ..... 2/102
5,008,986 4/1991 Laudet et al. .
5,669,078 * 9/1997 Scremin et al. ..... 2/247
5,826,273 10/1998 Eckes .
5,864,889 * 2/1999 Suffern ..... 2/247

* cited by examiner

*Primary Examiner*—Gloria M. Hale
(74) *Attorney, Agent, or Firm*—Greenblum & Bernstein, P.L.C.

(57) ABSTRACT

A jacket provided with a pocket that is internal of the jacket, but which is accessible from the exterior. The pocket is positioned on the front of the jacket, in the top portion of the sleeve. The opening of the pocket has one edge that is a part of the torso-enveloping portion, and one edge that is a part of the sleeve. The device for closing the opening is a part of the mechanism for assembling the sleeve to the torso-enveloping portion.

39 Claims, 3 Drawing Sheets

JACKET WITH AN IN-SLEEVE POCKET

BACKGROUND OF THE INVENTION

1. Field of the Invention

The present invention relates to a jacket that is provided with a pocket, the jacket being adapted to the practice of any sport, including skiing, snowboarding, skateboarding, cross-country skiing, in-line skating, etc.

2. Description of Background and Relevant Information

In the prior art, there are numerous pocket systems for jackets, but which are affixed onto the exterior of the jacket and, therefore, which are unaesthetic. In addition, these pockets, which are often placed in pairs in the area of the hips or the chest, hinder the athletic movements and become unusable when a backpack is used. The invention described in U.S. Pat. No. 5,826,273 includes pockets placed about everywhere on the garment, and more particularly on top of the shoulders, at the arm junction. The purpose of this pocket system is to place heating elements as close to the body as possible. Because the garment is skintight, the pockets are affixed to the exterior thereof. However, these pockets remain unaesthetic and are not integral with the garment.

In U.S. Pat. No. 4,006,495, a jacket is disclosed having an internal pocket adapted to store a removable sleeve. The opening of the pocket is located in the area of the attachment of the sleeve to the garment, but on the back. Accessing such a pocket, while the jacket is worn, would necessitate performing a contortion of the shoulders and arms. Therefore, it cannot be used for storing common objects or for obtaining convenient access to such objects.

SUMMARY OF THE INVENTION

An object of the present invention is to propose a jacket provided with a pocket that does not hinder the practice of the sport, which is practically invisible from the outer appearance of the jacket, and which can be accessed easily, even if the user is carrying a backpack.

Another object of the invention is to propose a pocket whose mode of construction limits the added cost for positioning it.

To achieve these objects, the pocket is positioned internally into the sleeve of the jacket, and it has an opening located at the junction of the top of the sleeve and of the torso enveloping portion. The opening of the pocket, located on the front surface of the jacket, has a closing device which is also a part of the means for assembling the sleeves to the torso enveloping portion. Thus, the pocket is internal and is practically invisible. Additionally, the positioning of the pocket does not require any cutout, nor any supplemental seam in the jacket, because its opening uses an edge of the piece constituting the torso enveloping portion and an edge of the piece constituting the sleeve.

In a first embodiment, the pocket is supported on the outer fabric of the sleeve. In a second embodiment, the pocket is independent of the outer fabric of the sleeve.

BRIEF DESCRIPTION OF THE DRAWINGS

The invention will be better understood and other advantages thereof will become apparent from the description, with reference to the annexed drawings which are an integral part thereof. The description illustrates, by way of non-limiting examples, certain preferred embodiments, in which.

DETAILED DESCRIPTION OF THE INVENTION

Figures 1, 2:
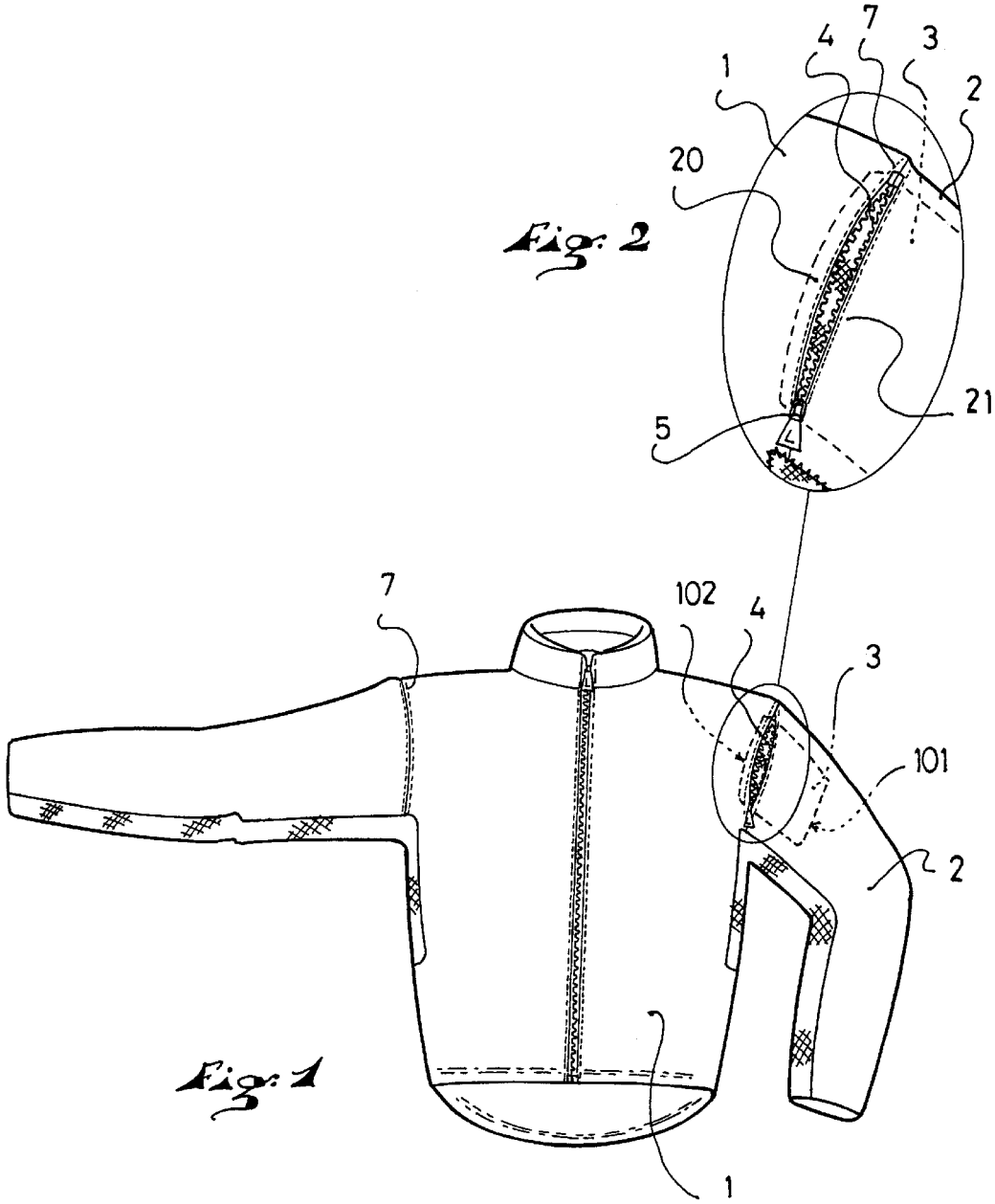
FIG. 1 shows a front view of a jacket provided with a pocket according to the invention.
FIG. 2 shows a detail of FIG. 1, in the area of the pocket.

FIG. 1 shows a jacket adapted to any outdoor activity and, more particularly, the practice of any sport, including alpine skiing, snowboarding, skateboarding, cross-country skiing, and in-line skating. The jacket is composed of at least one sleeve 2, attached to a torso-enveloping portion 1 by appropriate assembling means 7, such as stitched seams, for example. The torso-enveloping portion 1 can be made in one or more pieces, such as a front piece and a rear piece. The torso-enveloping portion 1 can also have shoulder and chest yokes. The construction mode of the torso-enveloping portion 1 is only provided by way of example, and is in no way limiting on the present invention.

The pocket 3 is positioned within the sleeve 2 and has an opening 4 that allows access to the pocket 3 from the exterior of the jacket. The opening 4 is located on the front surface of the vest and is oriented substantially straight upwardly. That is, as shown in the exemplary embodiment in FIGS. 1 and 2, the opening 4 extends substantially upwardly from a lower end to an upper end, along edge 20 of the torso-enveloping portion 1 of the jacket. More particularly, the opening 4 in FIG. 2 is shown to extend in a direction such that the opening has a slight upwardly facing component, i.e., such direction being slightly inclined to vertical. This arrangement makes it possible to have access to the pocket 3, even if the user carries a backpack. It also allows the free passage of the straps and, of course, the belt of the backpack. If the pocket is located to the left, the user would have access to it with his or her right hand, and vice versa.

FIG. 2 shows a detail of the opening 4 of the pocket 3. The pocket 3 has an opening 4 at at least one of the edges 20 which is a part of the torso-enveloping portion 1, and at at least one of the edges 21 which is a part of the sleeve 2. The opening 4 has a closing device 5 which can be of the zipper type with a pull, as shown in the drawing, or of the self-fastening type or the like, including the hook and loop fastener type. Preferably, the closing device 5 is part of the means 7 for assembling the sleeve 2 on the torso-enveloping portion 1.

To assemble the jacket, one can begin, for example, by obtaining the torso-enveloping portion 1 and the sleeve 2 separately. Then, a portion of the zipper 5 is sewn on the upper end of the sleeve 2, in the area of the edge 21; then, the other portion of the zipper is sewn on the edge 20 of the torso-enveloping portion 1. Finally, the torso-enveloping portion 1 is assembled to the sleeve 2 by stitching, in a known manner, outside of the zone occupied by the zipper 5. Advantageously, the zipper can be mounted in reverse, as described in U.S. Pat. No. 5,008,986, in order to obtain a quasi-imperviousness of the zipper. This mode of assembly limits the number of operations, because it is not necessary to cut a slit into the outer fabric to create the opening of the pocket. However, the geometry for the junction of the torso-enveloping portion I and of the sleeve 2 must be provided in order for the opening 4 of the pocket 3 to have the desired inclination. Advantageously, a straight armhole cut can be used to obtain a vertical opening 4, or a rounded, conventional or reduced armhole to obtain an opening with variable inclination. This latter arrangement allows the lower portion of the opening to be oriented toward the neck and, therefore, a natural geometry for introducing the hand into the pocket without distortion of the wrist.

With additional reference to FIGS. 3–6, different embodiments of the pocket itself will be described.

Figure 3:
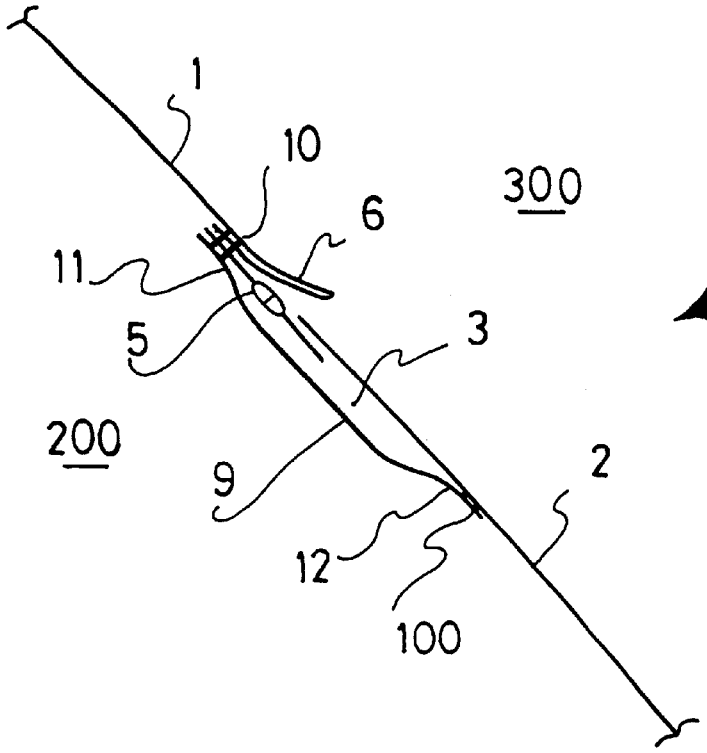
FIG. 3 shows a cross-section of the pocket in a first application of a first embodiment.

FIG. 3 shows the outer fabric of the sleeve 2 and of the torso-enveloping portion 1. The pocket 3 is obtained, on one side, by an attached internal surface 9 which has a perforated material and which is located on the inner side, and on the other side, by the outer fabric of the sleeve 2. The attached surface 9 is affixed, through its end 12, which is the lower end here, to the sleeve 2 by appropriate attachment means 100, such as a seam, which can include stitching. The end 11 of the attached surface 9, which is the upper end in this embodiment, includes attachment means 10 which affix the attached surface 9 to the inside of the torso-enveloping portion 1. To ensure imperviousness and to render the zipper 5 invisible, a flap 6 is associated with the torso-enveloping portion 1 and thus covers the closing device 5. A flap can also be associated with the sleeve 2, such that it covers the closing device 5. It is possible to combine the two previously described flaps, i.e., to employ both flaps for a single pocket. The flap makes it possible, among others, to mask, at best, the closing device 5 of the pocket 3.

The attached surface 9 can be made of a mesh fabric, for example, i.e., a fabric having an open network of interlacing threads. The assembly of the jacket is carried out substantially identically to that in the preceding description. However, the three sides of the attached surface 9, which can be rectangular, are affixed to the sleeve 2 by means of a seam 101. Then, the fourth side of the attached surface 9 is affixed to the torso-enveloping portion 1 by means of a seam 102. For economical considerations, this seam 102 can also affix the closing device 5 to the torso-enveloping portion 1. The seams 101 and 102 are shown in FIG. 1.

The pocket 3 thus obtained is of the flat type and is adapted to have a small volume to contain keys, credit cards, identification papers, etc., such as a size of about 7 centimeters by 7 centimeters. The pocket, when it is open and empty, can advantageously constitute a ventilation opening for the jacket in the area of the armpit, due to the aerated material of the attached surface 9.

Figure 4:
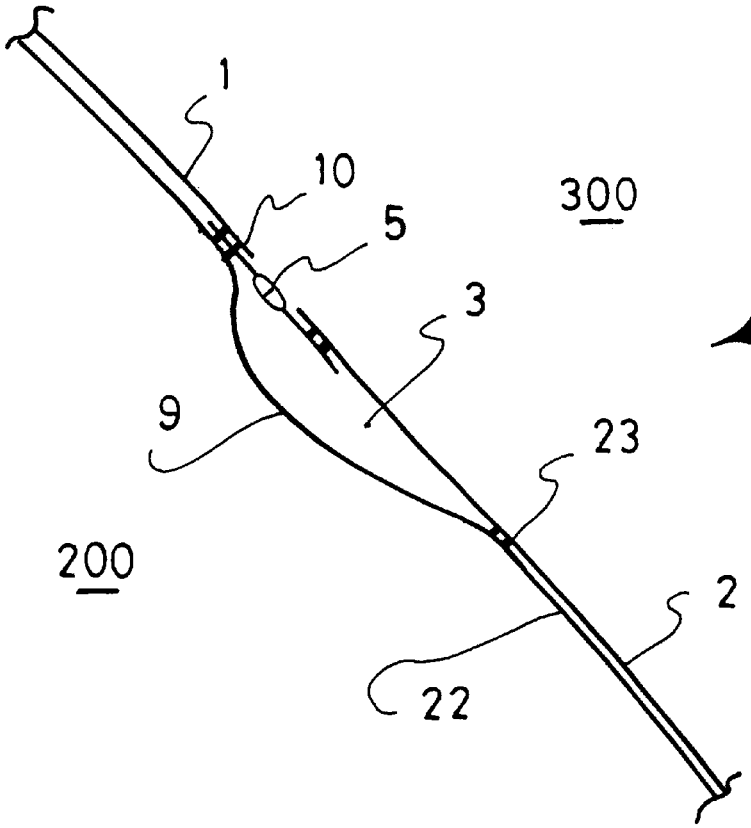
FIG. 4 shows a cross-section of the pocket in a second application of the first embodiment.

The entire description and the reference numerals of FIG. 3 apply to FIG. 4. In FIG. 4, the surface 9 of the pocket 3 is an integral part of the internal lining 22 of the sleeve 2. The pocket 3 is demarcated by a seam or hot welding 23 of the lining 22 on the outer fabric of the sleeve 2. This embodiment applies in particular to jackets of the breathable type which have an aerated mesh lining on the sleeves. This application is particularly adapted to a sport-oriented usage, such a skiing, snowboarding, skateboarding, biking, etc.

Figure 5:
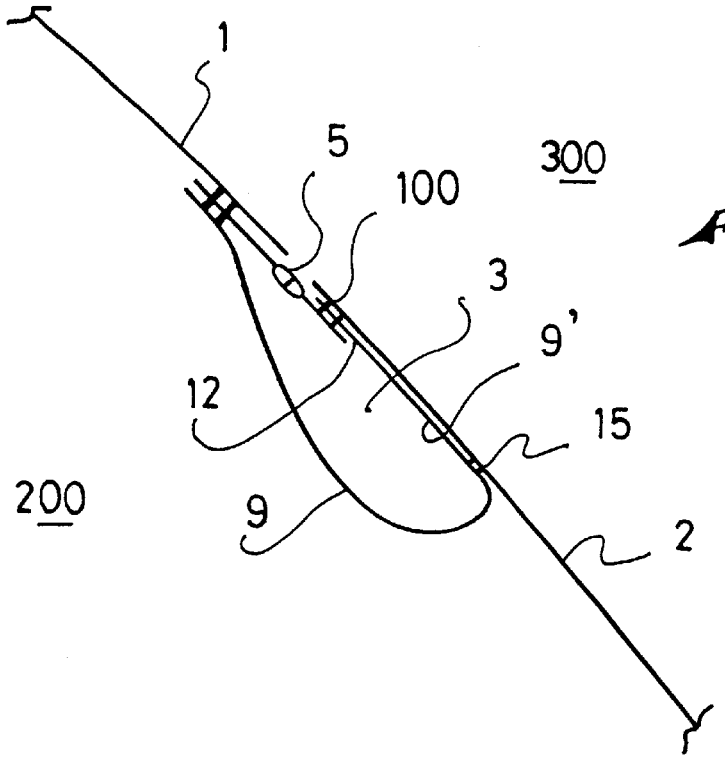
FIG. 5 shows a cross-section of the pocket according to the invention in a first application of a second embodiment.

In FIG. 5, the pocket 3 is constituted of a strip of fabric that is folded to form the two attached surfaces 9, 9' of the pocket 3. The end 12 of the surface 9' is therefore located in the vicinity of the closing device 5. For economical considerations, the means 100, such as stitching, for affixing the attached portion 9 on the sleeve 2 can also attach the closing device 5 on the sleeve 2. The pocket 3 thus obtained has a larger volume than in the previous embodiment and is not flat. The pocket 3 can advantageously include complementary attachment means 15 which flatten the pocket 3 against the sleeve 2. These complementary attachment means 15 can be a seam, hot welding, or a self-fastening attachment, and are arranged as far from the closing device 5 as possible.

Figure 6:
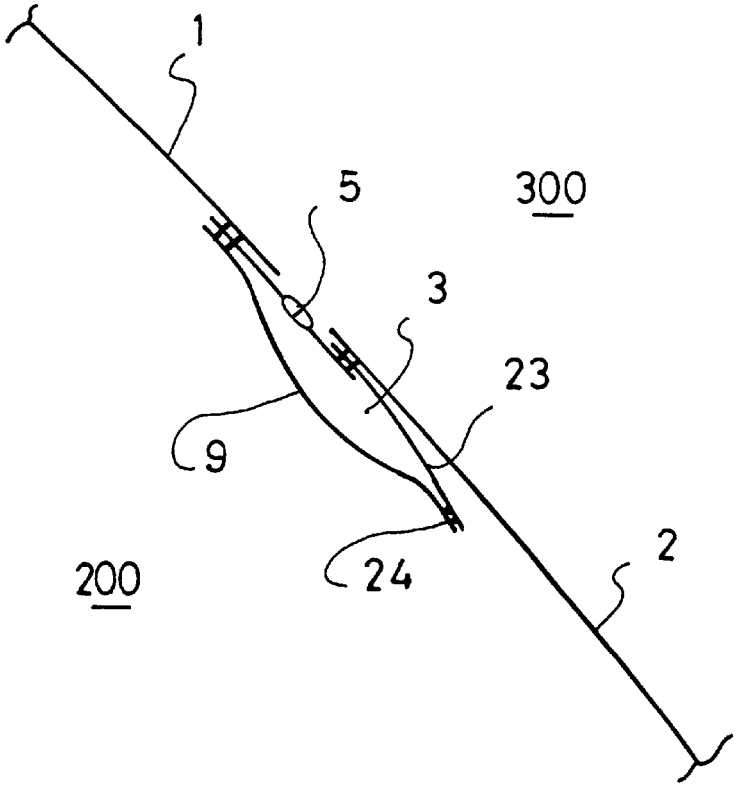
FIG. 6 shows a cross-section of the pocket in a second application of the second embodiment.

FIG. 6 shows the preferred embodiment for incorporating the pocket 3 into the jacket. The means for affixing the pocket 3 on the jacket are identical to those described in FIG. 5. However, the pocket 3 is made of two different materials. The attached surface 9, which is in contact with the arm of the wearer, is still made of an aerated material of the mesh type for its previously described ventilating function. The pocket 3 has a return 23 that is constituted of a stretchable material, for example, Lycra® spandex or a polar material. The attached surface 9 and the return 23 are connected to one another by a seam 24. This embodiment creates an extremely flat pocket which is preferably small sized to receive a credit card, identification papers, keys, etc. The pocket thus obtained does not move during the practice of the sport, especially if it is associated with a garment cut to fit snugly about the body. The absence of a seam on the outer fabric of the sleeve 2 guarantees the invisibility of the pocket, and does not modify the aestheticism of the jacket. This embodiment makes it possible to design aesthetics jackets while guaranteeing the necessary minimum for storage.

The embodiments and applications described above can be combined with one another. Thus, the invisibility of the closing device 5 of the pocket 3 can be perfected by associating a flap therewith, as described in FIG. 3.

In addition, the present invention is not limited to the particular embodiments described above, which are provided by way of illustration only, but encompasses all similar embodiments or equivalents.

What is claimed is:

1. A sport jacket adapted to the practice of any sport, including skiing, snowboarding, skateboarding, cross-country skiing, and in-line skating, said jacket comprising:

a torso-enveloping portion;

at least one sleeve attached to said torso-enveloping portion by assembling means; and a pocket positioned internally of said sleeve, said pocket including an opening, said pocket being located on a front surface of said jacket, said pocket being defined at least by two edges, at least one edge of said two edges being a part of said torso-enveloping portion, and at least a second of said two edges being a part of said sleeve.

2. A sport jacket according to claim 1, further comprising a closing device for manually opening and closing said opening.

3. A sport jacket according to claim 1, wherein said closing device comprises a zipper type device.

4. A sport jacket according to claim 1, wherein said closing device is a selffastening type device.

5. A sport jacket according to claim 2, wherein said closing device is part of said means for assembling said sleeve to said torso-enveloping portion.

6. A sport jacket according to claim 1, wherein said pocket includes at least one attached surface comprising a perforated material.

7. A sport jacket according to claim 6, wherein said attached surface of said pocket comprises at least one end, at said one end an attachment means is provided for affixing said attached surface within said torso-enveloping portion.

8. A sport jacket according to claim 7, wherein said attached surface of said pocket comprises a second end, at said second end an attachment means is provided for affixing said attached surface within said sleeve.

9. A sport jacket according to claim 1, wherein said pocket includes a complementary attachment means flattening said pocket against said sleeve.

10. A sport jacket according to claim 1, wherein at least one of said torsoenveloping portion and said sleeve has a flap that covers said closing device.

11. A sport jacket according to claim 1, wherein said opening is oriented substantially upright.

12. A sport jacket according to claim 1, wherein said sleeve includes a, lining.

13. A sport jacket according to claim 12, wherein said pocket includes an attached surface integral with said lining of said sleeve.

14. A sport jacket according to claim 1, wherein said pocket is located exclusively at said front surface of said jacket.

15. A sport jacket according to claim 1, wherein said pocket has a size less than a size of said sleeve.

16. A sport jacket according to claim 1, wherein said pocket has a lower end between said opening and an elbow area of said sport jacket.

17. A sport jacket according to claim 1, wherein said opening has an entirety of a length between opposite ends oriented substantially upright.

18. A sport jacket according to claim 1, wherein said pocket extends around less than an entirety of said sleeve.

19. A jacket comprising:

a torso-enveloping portion;

at least one sleeve attached to said torso-enveloping portion, said sleeve having an outer surface;

a pocket positioned internally of said outer surface of said sleeve, said pocket including an opening, said opening of said pocket being defined at least by two edges, at least one edge of said two edges being a part of said torso-enveloping portion, and at least a second of said two edges being a part of said sleeve.

20. A jacket according to claim 19, wherein said pocket is located on a front of said jacket.

21. A jacket according to claim 19, further comprising a closing device for manually opening and closing said opening.

22. A jacket according to claim 19, wherein said closing device comprises a zipper type device.

23. A jacket according to claim 19, wherein said closing device is a hook and loop fastening type device.

24. A jacket according to claim 21, wherein stitching attaches both said closing device and said sleeve to said torso-enveloping portion.

25. A jacket according to claim 21, wherein said pocket includes at least a perforated material to provide ventilation upon opening said opening.

26. A jacket according to claim 19, wherein said pocket comprises a piece of material, said piece of material including one end attached to said torso-enveloping portion and a second end attached to said sleeve.

27. A jacket according to claim 19, wherein said second end of said piece of material constitutes a bottom of said pocket.

28. A jacket according to claim 19, wherein said second end of said piece of material is attached to said sleeve at said second of said two edges of said pocket, said pocket having a bottom spaced along said sleeve away from both of said two edges of said pocket.

29. A jacket according to claim 28, wherein pocket is complementarily attached to said sleeve along a portion of said pocket spaced along said sleeve away from both of said two edges of said pocket.

30. A jacket according to claim 28, further comprising a flap covering said closing device.

31. A jacket according to claim 19, wherein said opening extends in a direction substantially upright.

32. A jacket according to claim 19, wherein said direction of said opening extends from, a lower end at a front of said jacket to an upper end to provide said opening with at least an upwardly facing component.

33. A jacket according to claim 19, wherein said sleeve includes a lining.

34. A jacket according to claim 33, wherein said pocket comprises an attached surface integral with said lining of said sleeve.

35. A jacket comprising:

a torso-enveloping portion;

at least one sleeve attached to said torso-enveloping portion, said sleeve having an outer surface;

a pocket positioned internally of said outer surface of said sleeve, said pocket including an opening, said pocket being defined at least by two edges, at least one edge of said two edges being a part of said torso-enveloping portion, and at least a second of said two edge, being a part of said sleeve;

said pocket comprising at least two pieces of material, a first of said two pieces of material attached at said one edge of said two edges of said pocket, a second of said two pieces; of material attached at said second edge of said two edges of said pocket, said first and second pieces of material being connected to one another at a bottom of said pocket within said sleeve.

36. A jacket according to claim 35, wherein said first of said two pieces of material being ventilated.

37. A jacket according to claim 36, wherein said second of said two pieces of material being stretchable.

38. A jacket according to claim 35, wherein said pocket is located exclusively at a front of said jacket.

39. A jacket according to claim 35, wherein said two pieces of material at said bottom of said pocket are not stitched to said sleeve.

* * * * *